United States Patent [19]

Büschgens et al.

[11] Patent Number: 4,698,878

[45] Date of Patent: Oct. 13, 1987

[54] FIBER BALE OPENER AND METHOD OF OPERATING THE SAME

[75] Inventors: Manfred Büschgens, Monchen-Gladbach; Josef Temburg, Jüchen, both of Fed. Rep. of Germany

[73] Assignee: Trützschler GmbH & Co. KG, Monchen-Gladbach, Fed. Rep. of Germany

[21] Appl. No.: 827,743

[22] Filed: Feb. 10, 1986

[30] Foreign Application Priority Data

Feb. 11, 1985 [DE] Fed. Rep. of Germany ..... 3504590

[51] Int. Cl.[4] ..... D01G 7/04; D01G 7/14

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 2,509,823 | 5/1950 | Hughes | 19/80 R |
| 3,170,196 | 2/1965 | Denis | 19/80 R |
| 3,208,107 | 9/1965 | Kotter et al. | 19/145.5 |
| 3,360,831 | 1/1968 | Morikawa et al. | 19/80 R |
| 3,795,943 | 3/1974 | Eckrodt | 19/80 R |
| 4,554,708 | 11/1985 | Leifeld et al. | 19/81 X |
| 4,586,217 | 5/1986 | Kranefeld | 19/81 X |
| 4,623,099 | 11/1986 | Vosbein et al. | 19/80 R |

FOREIGN PATENT DOCUMENTS

| | | | |
|---|---|---|---|
| 2819292 | 11/1979 | Fed. Rep. of Germany | 19/80 R |
| 8327082 | 3/1985 | Fed. Rep. of Germany . | |
| 8327190 | 3/1985 | Fed. Rep. of Germany . | |
| 2037830 | 7/1980 | United Kingdom | 19/80 R |
| 0364694 | 5/1971 | U.S.S.R. | 19/80 R |

OTHER PUBLICATIONS

"The Design of the SRRL Bale-Opener-Blender", by J. I. Knotter & H. L. Salaun, Jr.; Textile Bulletin, Mar. 1967, pp. 1-2.

*Primary Examiner*—Louis K. Rimrodt
*Attorney, Agent, or Firm*—Spencer & Frank

[57] ABSTRACT

A fiber bale opener includes a housing arranged for horizontal travel along a series of fiber bales and a pair of horizontally spaced, parallel opening rollers defining an intermediate space therebetween. Each opening roller has a rotary axis oriented transversely to a direction of horizontal travel and each is supported in the housing for travel therewith above the fiber bales. Each opening roller further has peripherally situated fiber tuft removing elements arranged for penetrating top surfaces of the fiber bales in a working zone of the opening rollers. The fiber bale opener also has a suction device in the housing for drawing away fiber tufts removed by the opening rollers. The opening rollers are rotated in opposite directions such that in the working zone the rotary directions of the opening rollers are oriented away from one another.

11 Claims, 3 Drawing Figures

FIBER BALE OPENER AND METHOD OF OPERATING THE SAME

BACKGROUND OF THE INVENTION

This invention relates to a fiber bale opener including two rapidly rotating opening rollers provided with fiber tuft removing elements, such as sawteeth and situated above a row of free-standing fiber bales. The opening rollers are mounted in a back-and-forth travelling arrangement and during such travel and rotation of the opening rollers, the teeth thereof project through a hold-down device such as a grate, into the upper surface of the bales and remove fiber tufts therefrom which are subsequently drawn away by a vacuum system.

U.S. Pat. No. 3,208,107 discloses a bale opener which travels up and down along a side of the bales. The opening device has two opening rollers whose teeth project through bars of a grate and remove tufts from the bale sides. The direction of rotation of the opening rollers in the zone of the bale surface (that is, the working zone of the opening rollers) is oriented inwardly, that is, in that zone the opening rollers rotate towards one another. As a result, the material removed by the opening rollers presents a mutual obstruction to the flow of material in the intermediate space between the rollers during the tuft intake and discharge. It is a further disadvantage of the prior art device referred to above that the tufts are, in part, wedged between the teeth and thus remain on the roller and repeatedly revolve therewith.

SUMMARY OF THE INVENTION

It is an object of the invention to provide an improved bale opener of the above-outlined type from which the noted disadvantages are eliminated and which in particular permits an improvement of the tuft removal from the bale and withdrawal from the working zone of the opening rollers.

These objects and others to become apparent as the specification progresses, are accomplished by the invention, according to which, briefly stated, the direction of rotation of the opening rollers arranged adjacent and axially parallel to one another in the zone of the upper face of the fiber bales is oriented outwardly (away from one another) in the working zone.

By virtue of the measure according to the invention the supply of the suction air from the outside is equally advantageous for both rollers and may be effected along a short path, whereby the guidance of air is improved. The fiber tufts removed by both opening rollers are thrown thereby at separate locations at opposite sides of the working zone directly into the air stream supplied from the outside. Thus, the fiber material thrown by the one and the other opening roller - contrary to the known apparatus - does not constitute an obstruction during the opening of the fiber bale and the tuft removal from the working zone of the opening rollers. Further, the quantity of fiber tufts continuously revolving with the opening rollers is reduced because the fiber tufts may leave from between the teeth of the opening rollers without impediment.

According to a further feature of the invention, the walls of the tuft suction device surround the opening rollers from the outside (that is, at a location remote from the intermediate space defined between the two opening rollers). Between the lower end of the walls and the upper face of the bales a gap is provided through which air enters into the space between the walls and the opening rollers. In this manner, the fiber tufts are admitted along a short path into the vacuum stream so that both at the beginning and at the end of the fiber bale series only a very small amount of removed fiber material is lost, since the fiber tufts are immediately entrained, in a short path, by the suction system. According to a further advantageous feature of the invention, the distance between walls of the suction system and the opening rollers is adjustable, for example, by a rotatable gate, a slide or the like in order to regulate the strength of the suction air stream. Expediently, within the tuft withdrawing device an air guide element is provided to ensure that the air stream with the tufts is guided in a flow-dynamically advantageous manner into the suction device. According to a further advantageous feature of the invention, at the air guide element stripper elements (knives) are arranged which are associated with the opening rollers for removing projecting fiber tufts from the teeth of the opening rollers.

Underneath the opening rollers there is provided a grate formed of two grate halves each composed of a plurality of grate bars. According to a further feature of the invention, the ends of the grate bars are at a vertical distance from the bale surface in the zone of the gap between the two opening rollers. As a result, in that zone the grate bars are not in contact with the bale surface so that no friction or resistance is generated in that location. According to still another feature of the invention, the grate bars of the two grate halves are arranged laterally offset with respect to one another so that the teeth of one opening roller in each instance project into the tracks of the other grate half and conversely. By means of this arrangement an alternating grate which is laterally shifted after each working pass may be dispensed with. Expediently, the ends of the grate bars are secured to a common support element. In this manner, the grate bars may be secured in a simple manne in the intermediate space between the opening rollers without affecting the removed fiber tufts. The support element may be a bar or the like held laterally at both ends on the housing of the opening device.

DESCRIPTION OF THE PREFERRED EMBODIMENT

Figure 1:
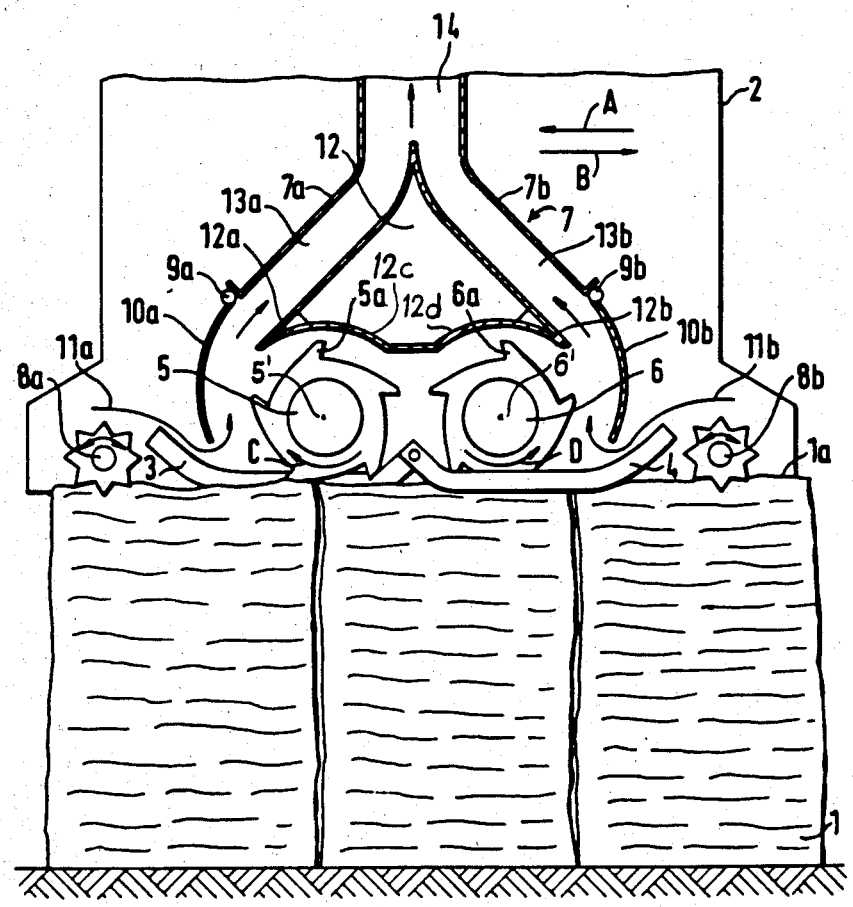
FIG. 1 is a schematic sectional side elevational view of a preferred embodiment of the invention.
Figure 2:
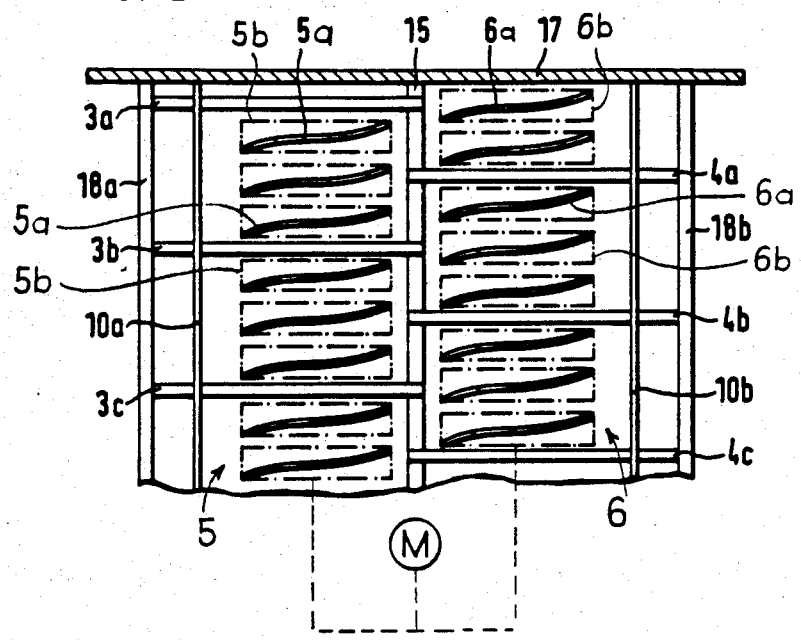
FIG. 2 is a schematic top plan view of one part of the construction shown in FIG. 1.

Turning to FIG. 1, fiber bales 1 are arranged in a free-standing series on the ground. On rails (not shown) running alongside the bales, there is mounted for back-and-forth travel a carriage (also not shown) on which there is mounted a vertically shiftable opening device which comprises a housing 2, two grate halves 3 and 4, two parallel-arranged opening rollers 5 and 6 and suction ducts 7. The opening device is arranged for back-and-forth travel in the direction of arrows A and B. The rotary axis 5', 6' of the respective opening roller 5, 6 is horizontal and is oriented perpendicularly to the travelling directions A, B. The grate halves 3 and 4 extend into the respective axial clearances between teeth **5*a*, 6*a* underneath the opening rollers 5 and 6, as also shown in FIG. 2. The grate halves 3 and 4 engage the upper surface 1***a* of the fiber bales 1, thus constitutinq a hold-down devioe. Upstream and downstream of the opening roller 5, 6 there are arranged axially parallel pressing rollers (support rollers) 8*a*, 8*b* which press on the surface 1*a* of the fiber bales 1. In this manner, the fiber bales 1 are immobilized in their position and thus secured against shifting or tipping over.

In the working zone, that is, adjacent the upper surface 1*a* of the fiber bales 1, the direction of rotation of the opening rollers 5 and 6, shown by arrows C and D, respectively, is oriented in an outward direction, that is, away from one another. The teeth 5*a* and 6*a* of the opening rollers 5 and 6 are oriented in the respective direction of rotation, that is, they point away from one another in the working zone.

Also referring to FIG. 2, the opening rollers may be driven from a common drive motor M with transmission elements, such as chains appropriately oriented to ensure opposite directions of rotation as indicated by arrows C and D.

The suction device 7 shrouds the opening rollers 5 and 6 from the outside, and has two walls 7*a*, 7*b* which, at their lower end, carry a respective curved gate 10*a*, 10*b* by means of a respective pivotal joint 9*a*, 9*b*. The lower end of the curved gates 10*a*, 10*b* is arranged at a distance from the upper face l*a* of the fiber bales 1 so that an air stream ll*a*, 11*b* may be admitted into the suction device 7 through the gap between the upper bale face l*a* and the lower edge of the gates 10*a*, 10*b*. The qates 10*a* and 10*b* are adjustable about their respective pivotal joint 9*a*, 9*b* for varying their distance from the opening rollers 5 and 6, respectively. In the inner space of the suction device 7 there is provided an air guiding element 12 which defines two channels 13*a* and 13*b* with outer walls 7*a and* 7*b* of the suction device 7. The channels 13*a*, 13*b* merge at an upper end of the suction device 7 into a common channel 14 leading to a suction fan (not shown). At the lower ends of the air guide element 12 there are provided stripper elements (knives) 12*a*, 12*b* which are oriented approximately tangentially to the opening rollers 5 and 6, whereby they can strip projecting fiber tufts from the opening rollers 5 and 6. The air guide element 12 is approximately triangular in section; its bottom side (the hypotenuse) has two arcuate portions 12*c* and 12*d* which generally conform to the curvature of the respective opening rollers 5 and 6 and are arranged at a distance therefrom.

During operation, the opening rollers 5 and 6, carried by the fiber bale opening device, travel above the free-standing fiber bales 1 back and forth and the teeth 5*a* and 6*a* of the opening rollers 5 and 6 project through the grate halves 3 and 4 into the surface of the fiber bales. The fiber tufts removed from the surface regions of the fiber bales by the opening rollers are thrown outwardly by the opening rollers 5 and 6. The fiber tufts are thus admitted directly into the air streams ll*a*, ll*b* and are, through channels 13*a* and 13*b*, admitted into the common duct 14 and drawn away by suction.

Turning once again to FIG. 2, there are shown grate bars 3*a*, 3*b*, 3*c* and 4*a*, 4*b*, 4*c* constituting the respective grate halves 3 and 4 and extending parallel to one another over the width of the upper face 1*a* of the fiber bales 1. Between the grate bars there are schematically shown the teeth 5*a* and 6*a* of the respective opening rollers 5 and 6; the individual working zones of the teeth 5*a*, 6*a* at the upper surface 1*a* of the fiber bales during their rotation is indicated by individual rectangles 5*b*, 6*b* shown in dash-dot lines. The grate bars 3*a*, 3*b*, 3*c* are laterally offset with respect to the grate bars 4*a*, 4*b*, 4*c*. In this manner, the troughs (trenches) formed in the upper face 1*a* of the fiber bales may be eliminated by the respective oppositely lying opening roller 5 or 6. The ends of the grate bars 3*a*–3*c* and 4*a*–4*c* are, in the zone of the clearance between the opening rollers 5 and 6, secured to a common support element 15 which, in turn, is held in the side walls 17 (only one shown) of the housing 2. The externally located ends of the grate halves 3 and 4 have a sufficient distance from the opening rollers 5 and 6 so that a fiber tuft withdrawal by suction is not obstructed. The ends of the grate halves 3 and 4 cooperate with respective holding elements 18*a*, 18*b*.

Figure 3:
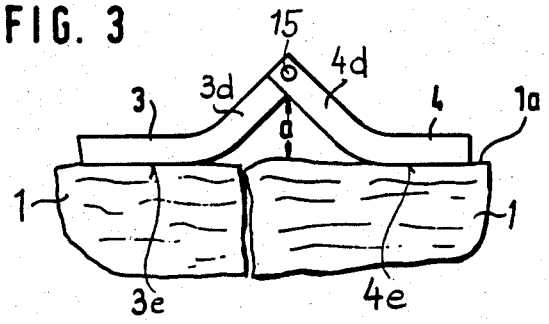
FIG. 3 is a schematic side elevational view of a detail of FIG. 1.

Turning now to FIG. 3, in the zone between the two opening rollers 5 and 6, the grate bars of the grate halves 3 and 4 have upwardly bent end portions 3*d*, 4*d* whose terminus is at a vertical distance a from the upper surface 1*a* of the bales 1 (that is, from the undersides 3*e*, 4*e* of the grate halves 3, 4 in engagement with the bales 1).

It will be understood that the above description of the present invention is susceptible to various modifications, changes and adaptations, and the same are intended to be comprehended within the meaning and range of equivalents of the appended claims.

What is claimed is:

1. In a fiber bale opener including a housing arranged for horizontal travel along a series of fiber bales; a pair of horizontally spaced, parallel opening rollers defining an intermediate space therebetween and each having a rotary axis oriented transversely to a direction of said horizontal travel; each opening roller being supported in said housing for travel therewith above the fiber bales; a generally horizontally oriented grate supported in said housing and extending below said opening rollers; each opening roller having peripherally situated fiber tuft removing elements arranged for extending through said grate and for penetrating top surfaces of said fiber bales in a working zone of said opening rollers; and suction means in said housing for drawing away fiber tufts removed by said opening rollers; the improvement comprising means for rapidly rotating said opening rollers in opposite directions such that in said working zone the rotary directions of said opening rollers are oriented away from one another.

2. A fiber bale opener as defined claim 1, wherein said suction means include shrouds surrounding each said opening roller along and spaced from an outer peripheral portion thereof situated remote from said intermediate space.

3. A fiber bale opener as defined in claim 2, wherein each shroud includes a portion adjustable towards or away from a respective said opening roller for arbitrarily setting a distance from a respective said opening roller.

4. A fiber bale opener as defined in claim 2, wherein said suction means further comprises an air guiding element supported in said housing above said opening rollers; said air guiding element defining, with each said shroud, air guiding channels arranged for guiding an air stream, laden with fiber tufts removed by the opening rollers, away from said working zone.

5. A fiber bale opener as defined in claim 4, further comprising stripper elements mounted on said air guiding element adjacent each said opening roller for stripping fiber tufts therefrom.

6. A fiber bale opener as defined in claim 1, further comprising a generally horizontally oriented grate supported in said housing and extending below said opening rollers; said grate having a plurality of spaced grate bars oriented parallel to said direction of horizontal travel; said teeth of said opening rollers projecting between and downwardly beyond said grate bars in said working zone; said grate bars having a first underside arranged to engage top portions of said fiber bales; said grate bars having, in said intermediate space defined by said opening rollers, a second underside being situated at a height level above said first underside for eliminating any friction between the grate bars and the top portion of said fiber bales in said intermediate space.

7. A fiber bale opener as defined in claim 1, further comprising a generally horizontally oriented grate supported in said housing and extending below said opening rollers; said grate having a plurality of spaced grate bars oriented parallel to said direction of horizontal travel; said teeth of said opening rollers projecting between and downwardly beyond said grate bars in said working zone; said grate being formed of a first grate half extending below one of said opening rollers and a second grate half extending below the other of said opening rollers; the grate bars of said first grate half being horizontally offset transversely to said direction of horizontal travel with respect to the grate bars of said second grate half.

8. A fiber bale opener as defined in claim 1, further comprising a generally horizontally oriented grate supported in said housing and extending below said opening rollers; said grate having a plurality of spaced grate bars oriented parallel to said direction of horizontal travel; said teeth of said opening rollers projecting between and downwardly beyond said grate bars in said working zone; said grate being formed of a first grate half extending below one of said opening rollers and a second grate half extending below the other of said opening rollers; the grate bars of said first and second grate halves having adjacent ends in said intermediate space defined by said opening rollers; said adjacent ends being mounted on a common holding element situated in said intermediate space and being supported in said housing.

9. A fiber bale opener as defined in claim 1, wherein said fiber tuft removing elements are teeth; the teeth of one said opening roller are oriented away from the teeth of the other opening roller in said working zone.

10. A method of removing fiber tufts from top faces of fiber bales with a fiber bale opener including a housing arranged for horizontal travel along a series of fiber bales; a pair of horizontally spaced, parallel opening rollers defining an intermediate space therebetween, each said opening roller having a rotary axis oriented transversely to a direction of said horizontal travel and each being supported in said housing for travel therewith above the fiber bales; a generally horizontally oriented grate supported in said housing and extending below said opening rollers; each opening roller having peripherally situated fiber tuft removing elements arranged for extending through said gate and for penetrating top surfaces of said fiber bales in a working zone of said opening rollers; and suction means in said housing for drawing away fiber tufts removed by said opening rollers; comprising the step of rapidly rotating said opening rollers in opposite directions such that in said working zone the rotary directions of said opening rollers are oriented away from one another; and throwing fiber tufts by said opening rollers in opposite directions oriented away from one another, directly into suction inlets forming part of said suction means.

11. In a fiber bale opener including a housing arranged for horizontal travel along a series of fiber bales; a pair of horizontally spaced, parallel opening rollers defining an intermediate space therebetween and each having a rotary axis oriented transversely to a direction of said horizontal travel; each opening roller being supported in said housing for travel therewith above the fiber bales; each opening roller having peripherally situated fiber tuft removing elements arranged for penetrating top surfaces of said fiber bales in a working zone of said opening rollers; and suction means in said housing for drawing away fiber tufts removed by said opening rollers; the improvement comprising means for rotating said opening rollers in opposite directions such that in said working zone the rotary directions of said opening rollers are oriented away from one another; and further wherein said suction means include separate suction inlets located immediately adjacent each said opening roller at an outer peripheral portion thereof situated remote from said intermediate space, whereby fiber tufts removed from the bales by said opening rollers are thrown thereby in opposite directions oriented away from one another, directly into respective said suction inlets.

* * * * *